US008764373B2

(12) United States Patent
Bates

(10) Patent No.: US 8,764,373 B2
(45) Date of Patent: Jul. 1, 2014

(54) UTILITY CARRYALL FOR UTILITY, SKID STEER AND INDUSTRIAL TRACTORS

(76) Inventor: Elwood Bates, Chilliwack (CA)

( * ) Notice: Subject to any disclaimer, the term of this patent is extended or adjusted under 35 U.S.C. 154(b) by 0 days.

(21) Appl. No.: 11/784,598

(22) Filed: Apr. 9, 2007

(65) Prior Publication Data

US 2008/0152469 A1 Jun. 26, 2008

Related U.S. Application Data

(60) Provisional application No. 60/876,535, filed on Dec. 22, 2006.

(51) Int. Cl.
*B66F 7/08* (2006.01)

(52) U.S. Cl.
USPC ..... 414/723

(58) Field of Classification Search
USPC ..... 414/723, 703, 607; 37/468; 52/385, 52/390, 780
See application file for complete search history.

(56) References Cited

U.S. PATENT DOCUMENTS

| | | | | |
|---|---|---|---|---|
| 1,451,404 A * | 4/1923 | Parks | | 296/204 |
| 2,425,892 A | 8/1947 | Michaels | | |
| 2,646,910 A | 7/1953 | Wiershing | | |
| 2,735,261 A | 2/1956 | McClernon | | |
| 3,889,833 A * | 6/1975 | Thomas | | 414/607 |
| 4,214,776 A * | 7/1980 | Nurse | | 280/760 |
| 4,389,155 A * | 6/1983 | Absher | | 414/723 |
| 5,364,224 A * | 11/1994 | Padgett | | 414/703 |
| 7,168,908 B2 * | 1/2007 | Diaz et al. | | 414/723 |
| 2005/0088009 A1 * | 4/2005 | Krueger et al. | | 296/184.1 |

* cited by examiner

*Primary Examiner* — Saul Rodriguez
*Assistant Examiner* — Brendan Tighe

(57) ABSTRACT

The UTILITY CARRYALL provides a safe reliable and efficient lift and transport support for users in the agricultural industries. It can be coupled to all hydraulic front loaders and rear 3point hitches on utility, skid steer and industrial tractors. It also can be attached to a forklift on a rear hydraulic 3point hitch and front loader on utility farm and skid steer tractors. The front support rack 22 supports a multiple adjusting coupling system FIGS. 1,6. This system provides a capability for coupling the utility carryall to all varying widths of front loader lift arms on utility tractors. A uniquely designed profile providing a method for a new unified structural support system in combination with a new multiple adjusting coupling system, illustrated in FIGS. 1, 6. This new method of fabrication provides an interrelated multifunctional exchange between integral elements of both systems. System unification provided a new fabrication process for reducing overall unit weight while increasing structural support providing dispersal of load stress throughout the whole unit. These features introduce a new dimension with major improvements in lift and transport support for the high tech hydraulic systems for utility tractors being used today. The Utility Carryall can be matched to provide safe and reliable support for small compact, medium and large size utility tractors with wide and varying ranges of hydraulic lift capacities.

1 Claim, 7 Drawing Sheets

UTILITY CARRYALL FOR UTILITY, SKID STEER AND INDUSTRIAL TRACTORS

CROSS REFERENCE TO RELATED APPLICATIONS

This application claims the benefit of provisional patent application Ser. No. 60/876,535 filed 2006, Dec. 22 by the present inventor.

FEDERALLY SPONSORED RESEARCH

Not Applicable

SEQUENCE LISTING OR PROGRAM

Not Applicable

BACKGROUND OF THE INVENTION

1. Field of Invention

This invention generally relates to a specific structurally improved UTILITY CARRYALL; one that can be utilized on the rear and or front of utility tractors, on the front of skid steer tractors, industrial tractors and fork lifts.

2. Prior Art

Originally the efforts to utilize the hydraulic lift capacity of the rear three-point hitch on utility tractors for lift and transport purposes were very limited. There are early indications a recognized need for a device with a deck for lift and transport support would be beneficial. However, early efforts produced solutions creating problems and unsafe situations. Farmers at the user level with limited time and capitol had to improvise to get the job done. Plywood with galvanized pipe and baling wire utilized to produce a temporary lift and transport deck would be a good example of early efforts. The ends of the pipe were inserted into the lift arm ends of the 3point hitch, at the rear of the tractor. Collars with set bolts were used to keep the hydraulic lift arms secured to the pipe. To keep the deck material level a rope or chain was attached to the rear corners of the deck material and inserted through the top link coupling holes on top of the rockshaft housing on the rear of the tractor. Large wooden boxes where used in the same manor. When front loaders began to appear with buckets short pieces of wood were affixed to the bucket and a piece of plywood attached for hauling materials the bucket was not intended for. A steel bed frame for a single bed, affixed inside of a bucket on a front loader with C-clamps to keep it in place was utilized many times by my father. These observations and many others noticed over the years, strongly indicate there was a recognized need for a tool or device that could be coupled to hydraulic systems on utility tractors. For many years my observations and searches failed to locate a farm equipment retail outlet in North America or Europe for a device related to my UTILITY CARRYALL. For whatever reason, the intended benefits of early patents failed to become a product for retail marketing. Searching many hours on the computer for retail outlets with equipment related to my UTILITY CARRYALL resulted in finding nothing. Many years of inquiring and checking retail outlets found no lift and support device related to my UTILITY CARRYALL. Shortly after the 3point hitch was introduced, inventors introduced several types of transport devices to be connected to the rear 3point hitches on utility tractors. My search for a patent at the U.S. PTO web site turned up the following closest related patents. U.S. Pat. No. 2,425,892 to Michael's (1947) discloses an early effort for providing a lift and transport device. Even though there are disadvantages with this patent they are applicable because of today's advanced technology. The pickup bed in this patent would have to be upgraded in most all areas of structural support to meet the demands of lift and transport support required at the user level today. The lift and transport support in this patent is limited to use on the rear 3point hitch only. The hydraulic lift arms would be in a better position for coupling ease and provide a greater lift capacity to higher elevations if they were positioned near the bottom of the pickup bed. U.S. Pat. No. 2,646,910 to Wearshing (1953) discloses another early patent for lift and transport needs. The lift arms on the rear 3point hitch are positioned to high on the Transport Box. The lift arms are positioned so high they have very little lift capacity or lift height. The sheet metal decking, side container walls and support elements are designed to provide a light and limited range of structural support. U.S. Pat. No. 4,214,776 to Nurse (1980) discloses a pickup container constructed of angle iron. For small utility tractors this type of design made with angle iron is structurally to heavy, these tractors are limited in their hydraulic lift capacity. For large utility tractors today, the use of angle iron on large pickup containers would introduce excessive flexing under heavy load stress. To overcome the flexing problems with the use of angle iron the pickup container would become unnecessarily heavy. U.S. Pat. No. 2,735,651 to McClemon (1956) discloses a tractor attachment that is limited for safe and reliable support dependability for use with utility tractors today. Containment of materials being transported would present a problem in many cases.

For many years major time and energy has been expended at the user level, trying to improvise methods for dependable and reliable utilization of the hydraulic lift and transport capabilities on utility tractors. However, these improvements resulted in temporary solutions for a short duration of time. The first improvised efforts at the user level indicated a need for a reliable lift and transport support system. The fact the user recognized a need was apparent. There are many justifiable reasons why this support need remained at the user level for so many years. To this day, for whatever reason, efforts to develop a dependable devise for lift and transport support with utility tractors has not been introduced with any success. Nevertheless the efforts of prior art to solve a long recognized problem indicates recognition of the need but these prior efforts have numerous disadvantages (a. When the 3point hitch was introduced early efforts to utilize the hydraulic system on utility tractors for lift and transport support was limited. One big problem with fabricating a device was keeping it structurally light because the hydraulic systems on early tractors where very limited in lift capacity. Most designs for a device providing reasonable support where restricted, in that they were to heavy and little support could be realized by the user.

(b). The placement of receptacle attachment points for the lift arms on the rear 3point hitch of utility farm tractors was placed to high on the lift support devices. This feature reduced lift capacity and height of lift with increased coupling difficulty.

(c). The structural design of many prior art support devices was narrow in width and extended to for to the rear. This created problems with most tractors because the loaded support device quickly shifted weight from the front axle, creating unsafe operational conditions.

(d). Prior art seemingly restricted utilization of a lift and transport device for use on rear hydraulic 3point hitches only. A multiple adjusting coupling system providing a reliable flexibility for use on front loaders of farm utility, skid steer and industrial tractors or forklifts offers the user more support versatility.

(e). Prior art has not introduced a dependable support device with a lift and transport support structurally compatible for use with tractors introduced for retail marketing since the 60's and 70's.

OBJECTS AND ADVANTAGES

Accordingly several objects and advantages of my Utility Carry all introduce improvements over prior art:

(a) to provide a UTILITY CARRYALL designed and constructed with steel tubing that provides reliable structural support features for use on large tractors, (b). to provide a UTILITY CARRYALL designed and fabricated with a unique unified structural support method that can be used with small and medium sized tractors, (c). to provide a UTILITY CARRYALL with safe and dependable support when coupled to utility tractors, skid steer tractors, industrial tractors and forklifts, (d) to provide load distribution options for job situations where two early all's are being used on the same tractor, one on the hydraulic front loader and one on the rear hydraulic 3 point hitch, (e) to provide a safe and reliable working platform when the carryall is coupled to fork lifts on rear 3point hitches, front loaders and industrial fork lifts, (f) to provide a UTILITY CARRYALL with safe and dependable support performance on farms, ranches and industrial work sites, (g) to provide a safe and reliable heavy duty lift and transport capability for utility tractors equipped with a rear hydraulic 3point hitch with front loader system, (h) to provide structural support with strength you can count on, for heavy support requirements at the user level (i) to provide loading convenience from ground level to 90 cm (36 in) above ground, (j) to provide a safe and reliable UTILITY CARRYALL deck for lifting and moving support materials to elevated areas when coupled to front loaders on utility tractors or to the tongs of industrial forklifts, (k) to provide equalized load distribution when using a carryall on the rear 3 point hitch on a utility tractor and a bucket on the front loader, (l) to provide a UTILITY CARRYALL with major beneficial maneuvering improvements when coupled to utility and industrial tractors.

Further objects and advantages are to introduce a UTILITY CARRYALL with time saving maneuvering improvements over the use of tongue and wheeled trailers. A UTILITY CARRYALL introducing major dependable improvements over prior art when coupled to utility, skid steer or industrial tractors and forklifts. A UTILITY CARRYALL providing a combination of simple, efficient and reliable operational support performance. A UTILITY CARRYALL that will provide reliable lift and transport support with heavy loads under prolonged working situations. A UTILITY CARRYALL introducing a wide range of options for securing support materials when being transported. These consist of removable sideboards, easy to remove drop down expanded metal sides and tailgate, or easy to remove plywood panels. The panels can be dropped into channels provided on the carry all rear support post and front support rack. A transport container installed on the deck of the carryall and secured by using the sideboard and panel receptacles. The transport container provides safe transportation for farm animals and other sensitive materials. A UTILITY CARRYALL providing hydraulic dumping features for larger tractors and one with a gravity and spring assisted manual device for smaller tractors. A UTILITY CARRYALL providing a lift and transport capability without axles or wheels. A UTILITY CARRYALL introducing multiple adjusting coupling features that can be utilized on existing utility tractors for a lift and transport need on farms, ranches and industrial job sights. The multiple adjustable coupling system can be utilized with numerous other support devices that are used on front loaders. A UTILITY CARRYALL providing overhead canopy protection when required. A UTILITY CARRYALL coupled to rear 3point hitches and front loaders for use with all utility tractors. A UTILITY CARRYALL coupled to front loaders on skid steer and industrial tractors. A UTILITY CARRYALL attached to the tongs on forklifts. A UTILITY CARRYALL structurally fabricated using a unified support method designed for use with small and medium sized tractors. Further objects and advantages will become apparent from a consideration of the ensuing description and drawings.

SUMMARY

In accordance with my present invention, the UTILITY CARRYALL comprising a lift and transportation support capability for a wide range of utility tractors. The UTILITY CARRYALL can be coupled to the rear hydraulic 3point hitch and front loaders of utility tractors. It can be coupled on front loaders of skid steer and industrial tractors or attached on the tongs of industrial forklifts. The UTILITY CARRYALL can be attached to the forklift tongs being used on front loaders and point hitches on all utility tractors also. The versatile multiple adjusting coupling system supported by the front support rack on the front of the UTILITY CARRYALL, introduces reliable versatility. These features provide a wide range of dependable support with most all conventional and industrial tractors and forklifts. The coupling system is designed with conventional coupling units or quick coupling units. These units introduce a unique feature enabling the user to couple the UTILITY CARRYALL to front loaders with conventional or quick coupling systems. A unique method introducing unified structural fabrication of the UTILITY CARRYALL provides a wide range of beneficial support when using small and medium sized tractors with limited hydraulic lift capacity.

DRAWINGS

Figures

Figure 8:
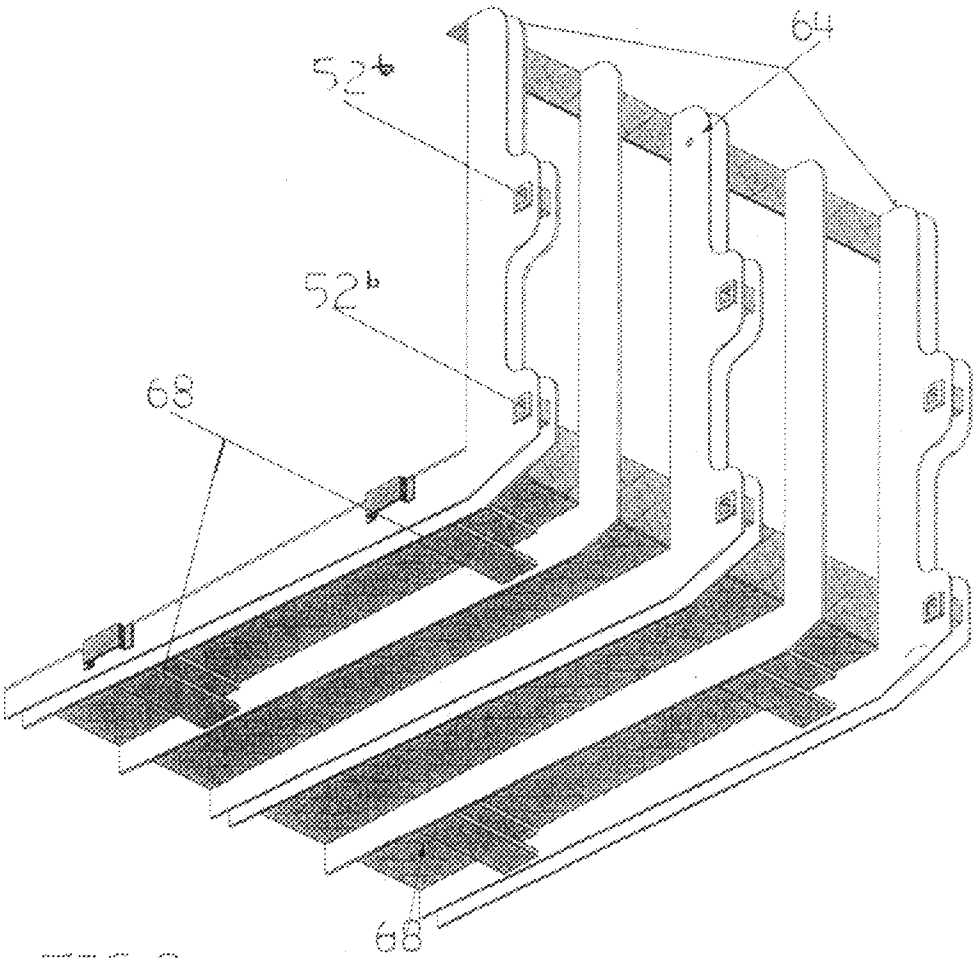

FIG. 8 shows a unified UTILITY CARRYALL viewed from underneath the deck, illustrating the predetermined structural support provided by the unified support members. The forklift tong guide retainers are also illustrated to show the simplicity of this feature. The rail hanger supports are illustrated without the rest of the multiple adjusting coupling system.

REFERENCE NUMERALS

| | |
|---|---|
| 20. deck | 22. front support rack with panel guide 22 (x) |
| 24. inside deck support strip | 26. outside frame rails (a)(b) |
| 28. rear frame rails | 30. front frame rail |
| 32. deck support rails (a)(b)(c) | 34. side panel receptacles |
| 36. side boards | 38. transport container |
| 40. rear tube post with panel guides 40 (x) | 42. removable drop down tailgate |
| 44. plywood panel | 46. top link coupling |
| 48. lift arm coupling (a)(b) | 50. support uprights (a)(b)(c) |
| 52. rail support hangers (3T)(3B) | 54. set bolts for rail hangers (6 each) |
| 56. adjusting support rails (1T)(1B) | 58. conventional coupling units (a)(b) |
| 60. quick coupling units (a)(b) | 62. set bolts for coupling units (4 each) |
| 64. unified support members | 66. industrial quick coupling units |
| 68. forklift tong guide retainers | |

DETAILED DESCRIPTION

FIGS. 1, 2, 4,5 and 7 Preferred Embodiments

Figure 1:
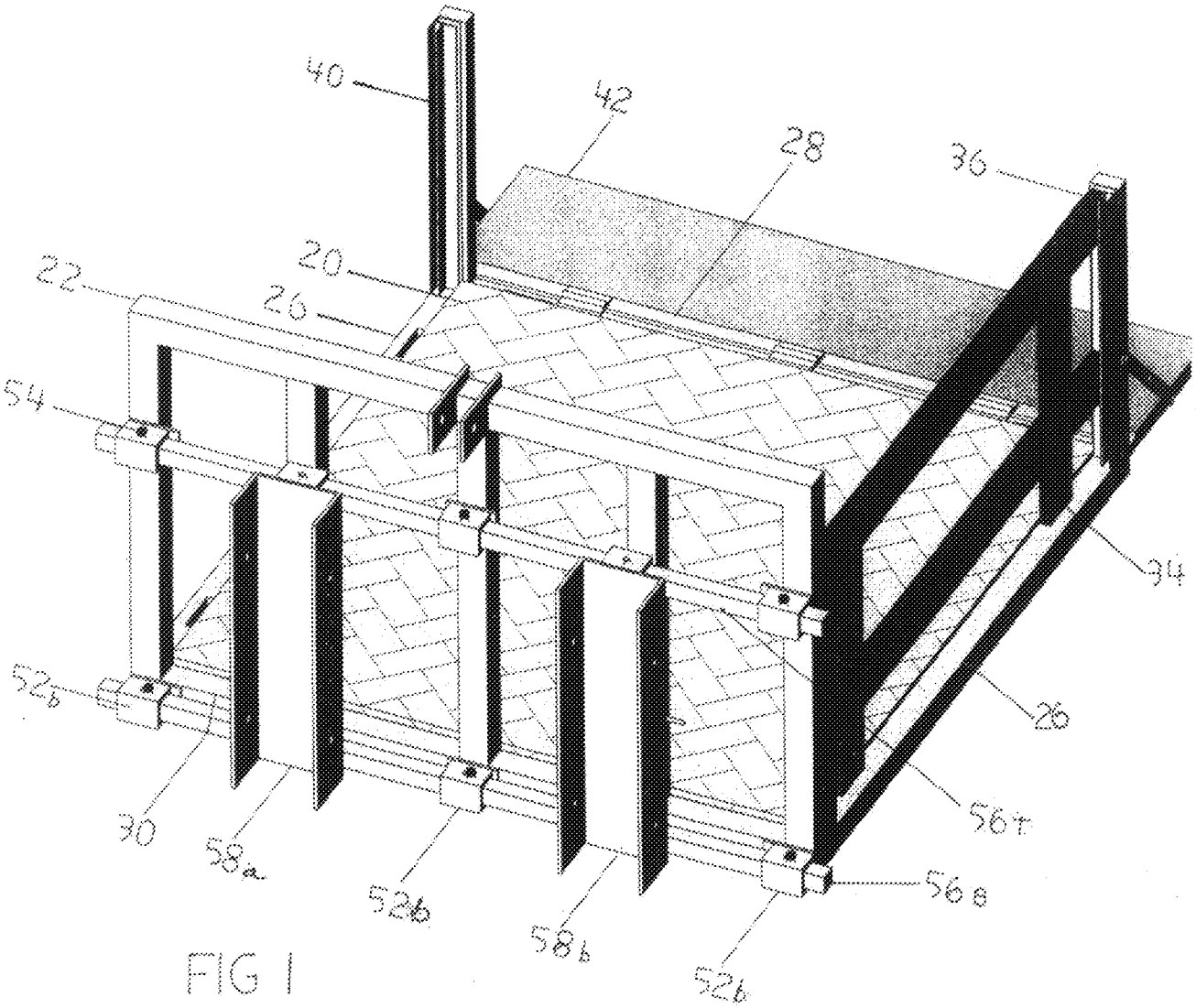
FIG. 1 shows a UTILITY CARRYALL fabricated with square and rectangular tubing with a deck, sideboards, tailgate, front support rack, with attached multiple adjusting coupling system.
Figure 2:
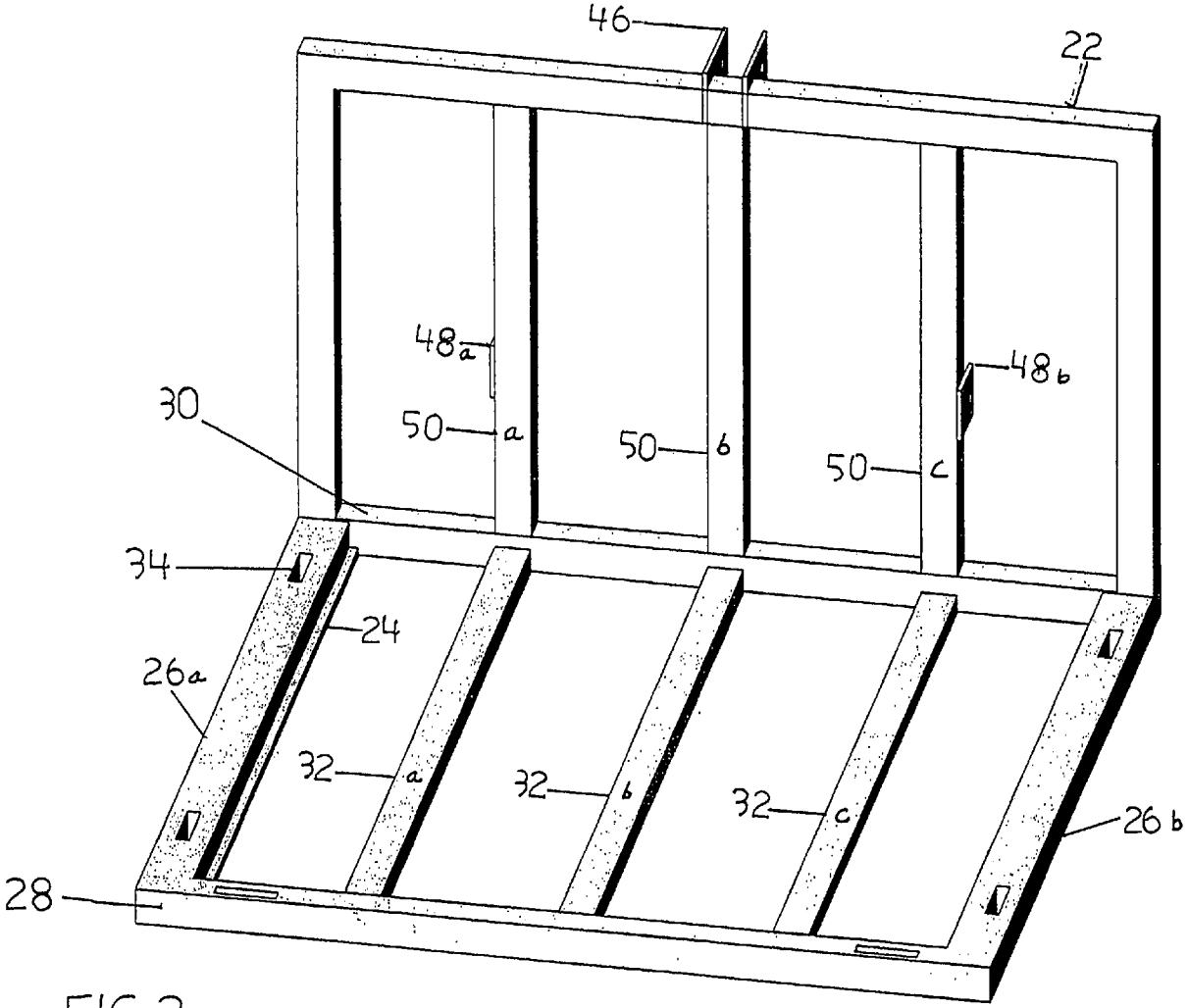
FIG. 2 shows the deck support frame and front support rack frame of the UTILITY CARRYALL without the decking and the front loader multiple adjusting coupling system shown in FIG. 1.
Figure 7:
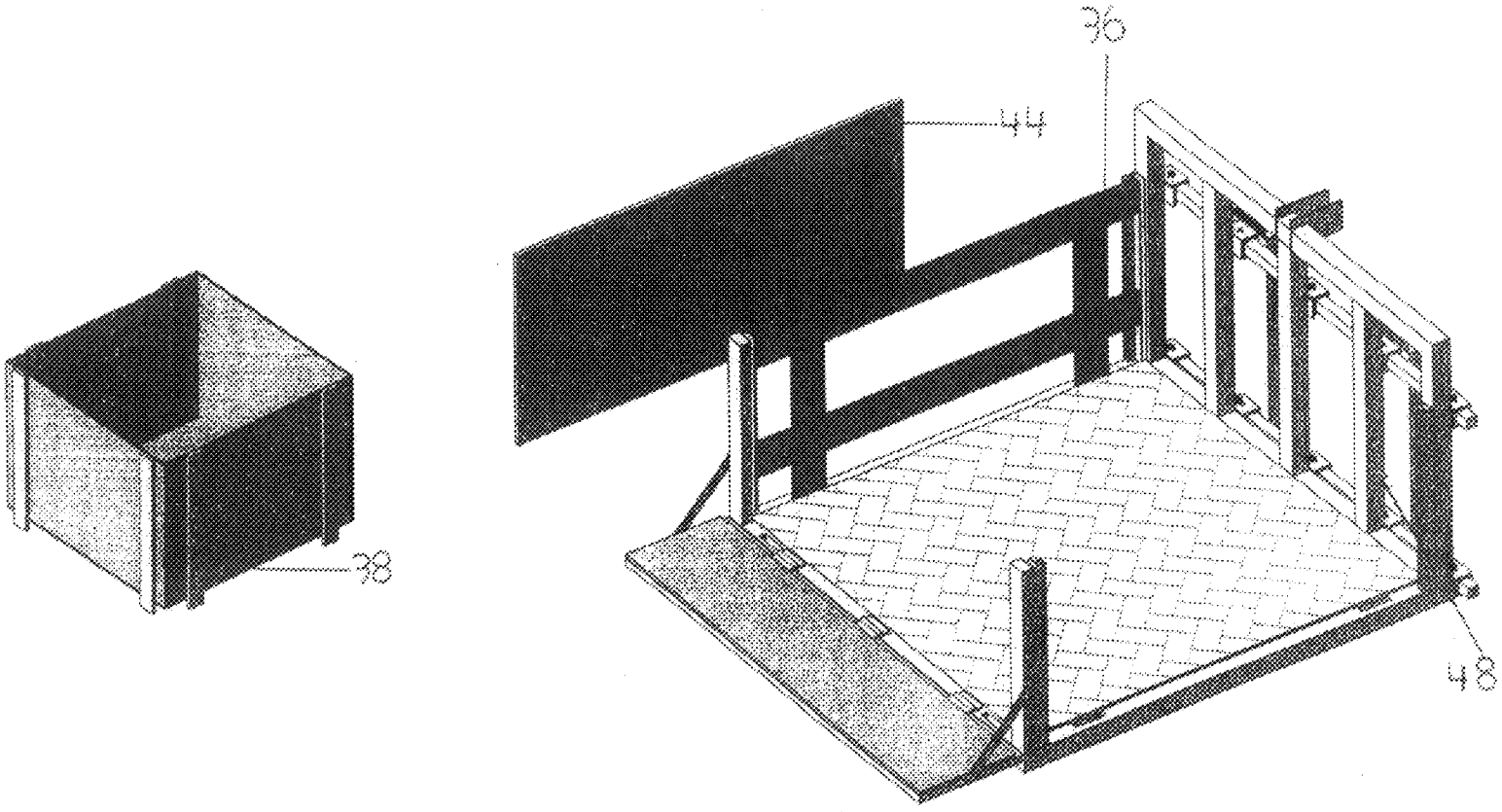
FIG. 7 shows a UTILITY CARRYALL fabricated with steel tubing illustrating deck sides and tailgate containment features for materials being transported.

A preferred embodiment of the UTILITY CARRYALL of my present invention in FIG. 1 shows a perspective front view looking down from an angle. This UTILITY CARRYALL is structurally designed and fabricated for utility tractors rated at 175 horsepower and above. The UTILITY CARRYALL in FIG. 1 has a frame constructed with square and rectangular tubing. It shows a preferred rectangular deck 20. The deck includes a front support rack 22 with a multiple adjustable coupling system. The coupling system consists of (6) rail support hangers 52 (3 on the top and 3 on the bottom), affixed to the support uprights 50 (*a*)(*c*) (FIG. 2) and two (2) each affixed to the rear top and bottom of the conventional coupling units 58 (*a*)(*b*) (FIG. 1) and quick coupling units 60 and 66 (FIG. 5 view 1,2 and 3), adjusting support rails 56 (1 on the top and 1 on the bottom), with multiple adjusting coupling units 58 (*a*)(*b*) (FIG. 1), sideboards 36 tailgate 42 and rear support posts 40. FIG. 2 illustrates inside deck support rails 32 (*a*)(*b*)(*c*) with outside frame rails 26 (*a*)(*b*) (FIG. 2) a front frame rail 30 (FIG. 2) and a rear frame rail 28 (FIG. 2) providing support for metal decking. Right-angled steel support strips 24 (FIG. 2) provide support for the outside edges of the decking material. These strips are affixed to the inside of the outside frame rails 26 (*a*)(*b*) The outside frame rails also have two side panel receptacles 34 (*a*)(*b*) (FIG. 2) for emplacing side panels. The upright front support rack 22 is affixed to the front deck frame rail 30 on the front end of the carryall in an upright (90 degree angle) position from the deck surface 20 (FIG. 1) at the front end. Square steel support uprights 50 (*a*)(*b*)(*c*) are affixed specifically in an upright support position inside the frame of the front support rack 22. On each side of the upright front support rack 22, panel guides 22*x* (FIG. 4) are provided. The panel guides 22*x* (FIG. 4) secure a side rack panel 44 (FIG. 7). There is a removable drop down tailgate 42 (FIGS. 1, 7), or a container 38 (FIG. 7) which can be utilized when needed to secure materials during transport.

FIGS. 1, 2, 3, 4

Additional Embodiments

Figures 3, 4:
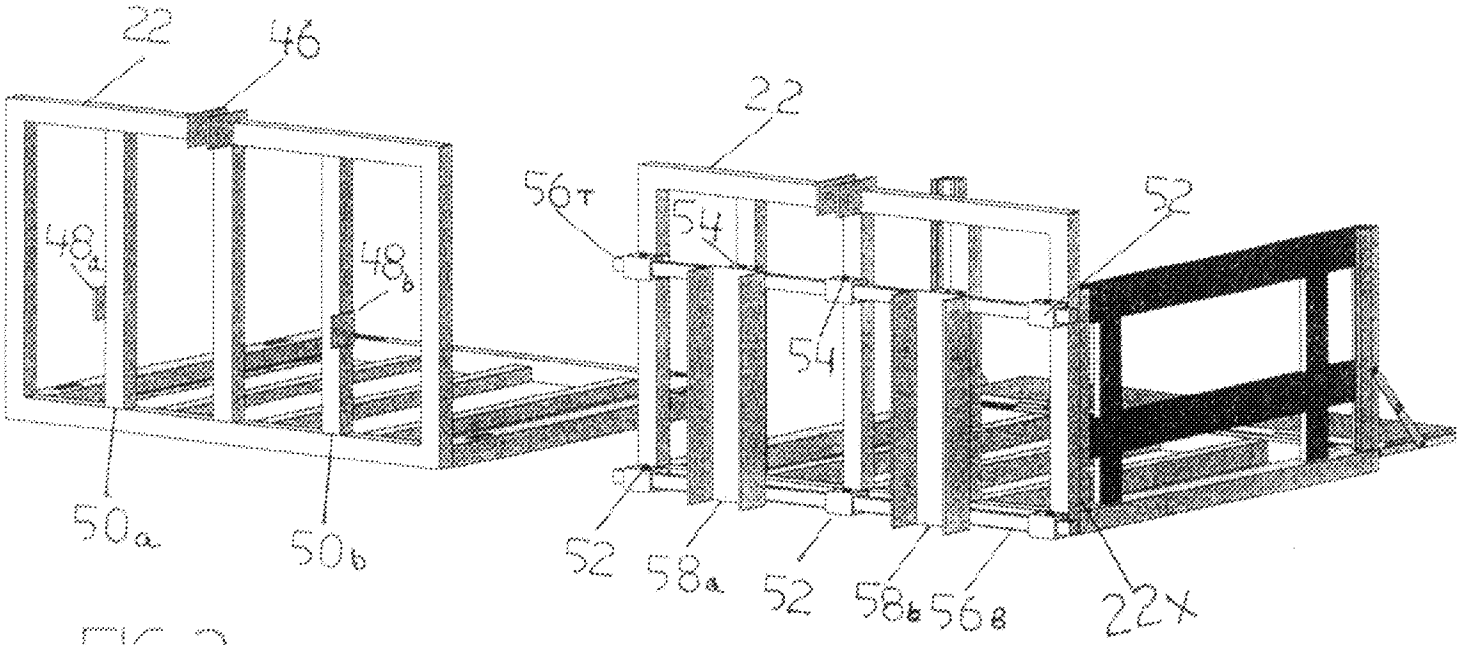
FIG. 3 shows a front frame view of a tube type constructed UTILITY CARRYALL with the front support rack illustrating only the 3 coupling points for the rear hydraulic 3point hitch on utility tractors.
FIG. 4 shows a UTILITY CARRYALL with both coupling systems in place on the front support rack.
Figure 5:
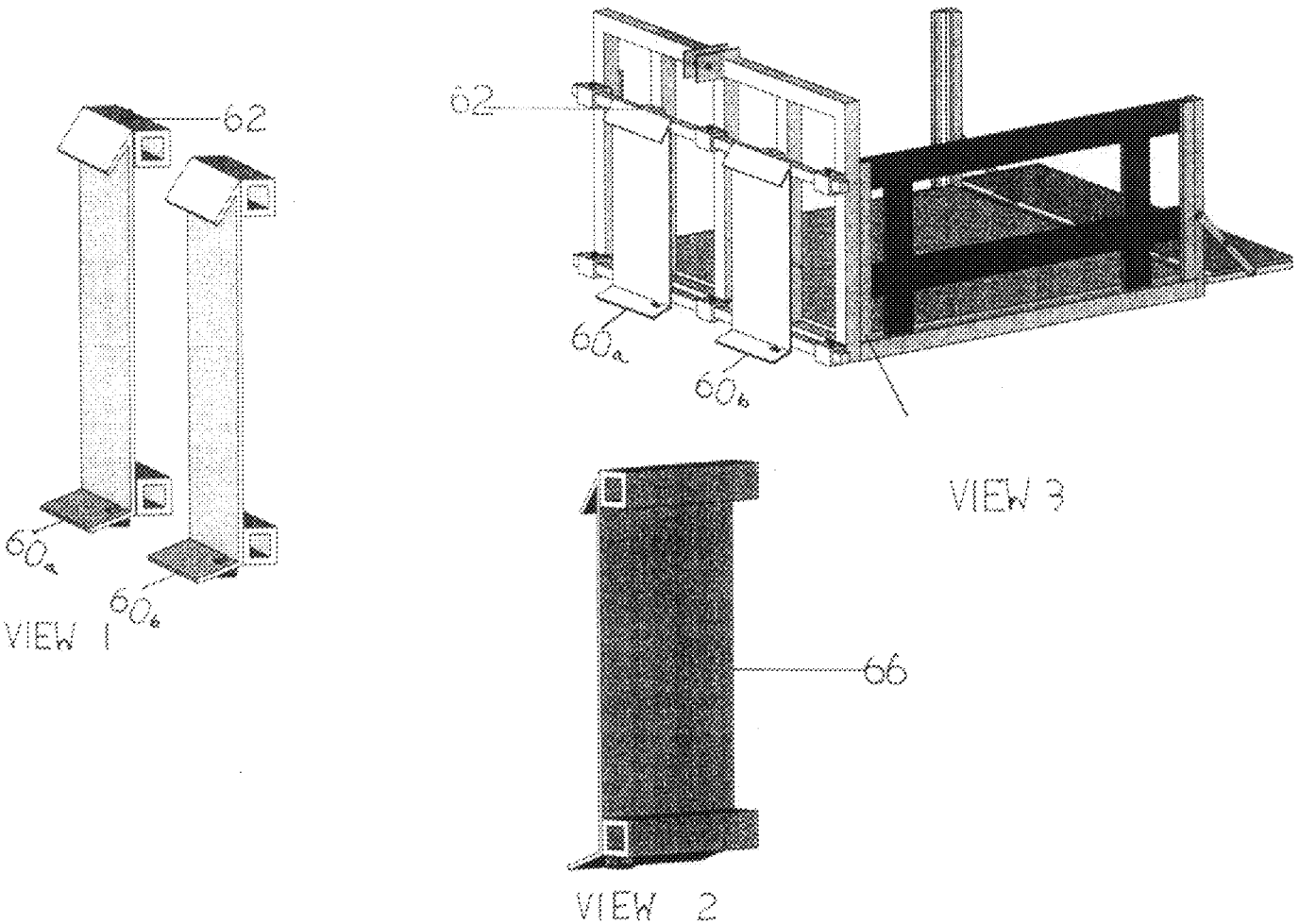
FIG. 5 shows the quick coupling units in three views for clarity.

The front support rack 22 (FIGS. 2, 3) provides support for another embodiment, the multiple adjusting coupling system (FIGS. 1, 4) consisting of (6) rail support hangers 52 (3 top and 3 bottom), (2) adjusting support rails 56 (1 top 1 bottom) and conventional coupling units 58 (*a*)(*b*). Quick coupling units 60 (*a*)(*b*) and industrial quick coupling units 66 (FIG. 5 view 2). The unique and flexible coupling system couples the UTILITY CARRYALL to all conventional and quick coupling systems on front loaders that are used with farm utility tractors, skid steer tractors, industrial tractors and forklifts. An additional embodiment shown in FIG. 8 provides forklift guide tong retainers 68 for attaching the utility carryall on forklifts. The coupling system is supported by six (6) square tube rail support hangers 52 (FIG. 1) and are affixed (3 on the top and 3 on the bottom) to the support uprights 50 (*a*) *c*) (FIG. 2). The support uprights further provide interior structural support for the front support rack. The hangers are illustrated in (FIGS. 1, 4, 5 at view 3). The square tube hangers 52 (FIGS. 6 8) for the UTILITY CARRYALL, fabricated for unified support members 64 (FIGS. 6,8) are inserted into the square cutouts in the six unified support members. Affixing these hangers 52 (FIGS. 6 8) into the square cut outs in the six unified support members supporting the hangers contributes to a major increase in structural support. The hangers 52 (3 top and 3 bottom) for the unified support UTILITY CARRYALL provide support for adjusting slide rails 56 (1 top and 1 bottom) FIG. 6. The adjusting support rails 56 (1 top and 1 bottom) slide through the hangers and provide support for the conventional coupling units 58 (*a*)(*b*) (FIGS. 1, 6) or quick coupling units 60 (*a*)(*b*) and 66 (FIG. 5). The conventional coupling units 58 (*a*) (*b*) (FIGS. 1, 6) and quick coupling units 60 (*a*)(*b*) and 66 (FIG. 5) only one is shown are designed for installation on the adjusting rails 56 (1 top and 1 bottom) FIG. 6. Each coupling unit will slide left or right from the center of the adjusting rails a distance of 52 cm or (22 in.). The range of adjustment provides a versatile capability to couple the UTILITY CARRYALL to all conventional and quick coupling devices on loaders being used with utility farm tractors, skid steer tractors and industrial tractors. Set bolts 54 (FIGS. 1, 3, 4) are affixed on the tops of the rail support hangers 52 (FIG. 1) that are affixed to the upright front support rack 22 (FIG. 1) and the unified support members 64 making up the unified upright front support rack 22. Set bolts 62 (FIG. 5 view 1) are affixed on the tops of the rail support hangers that are affixed to the rear top and bottom of the coupling units. When final adjustments are made the set bolts are tightened, fixing in place the adjusting support rails 56 (FIG. 1) and the coupling units.

Figure 6:
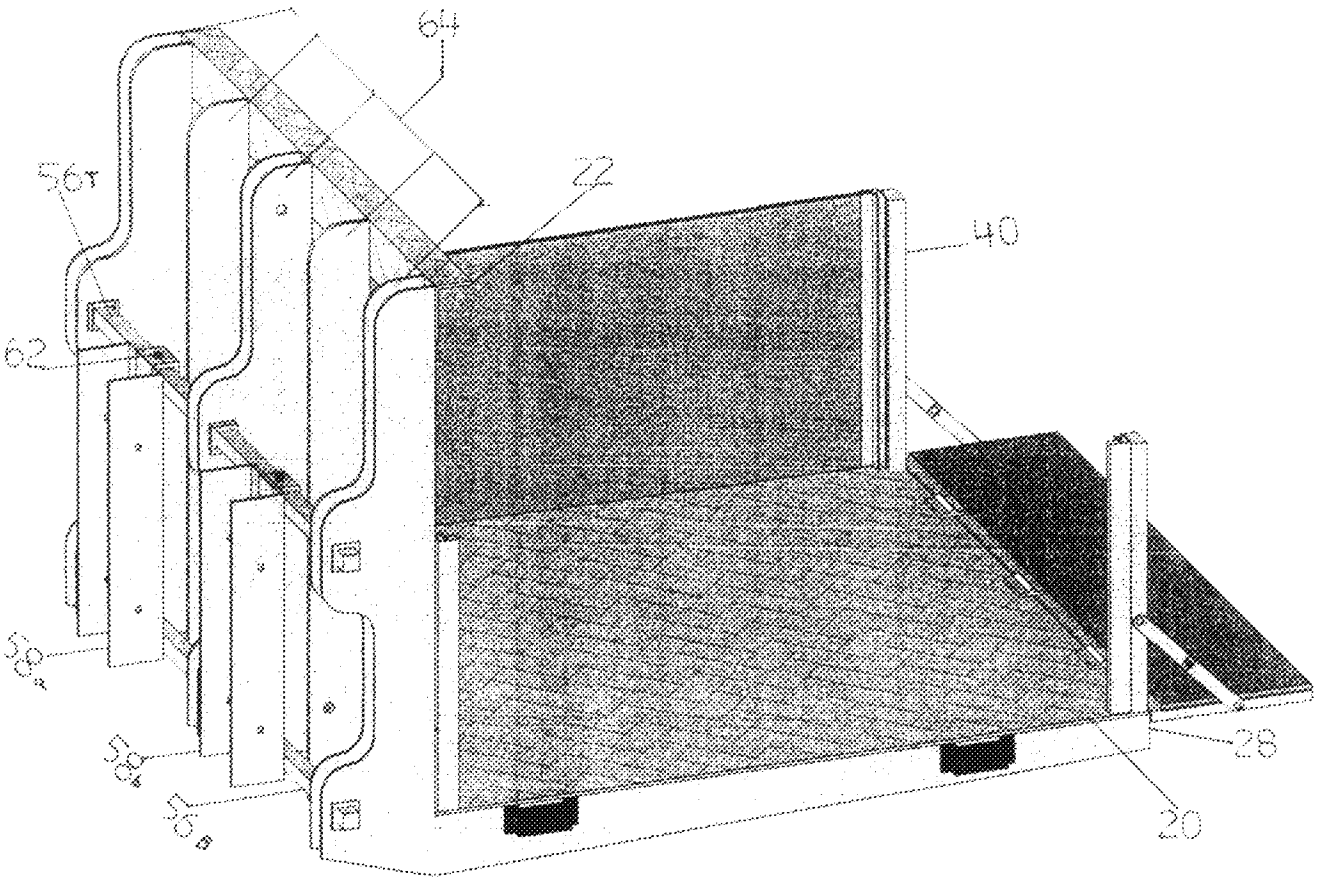
FIG. 6 shows a UTILITY CARRYALL fabricated with unified support members for small and medium sized tractors.

FIGS. 6 and 8

Alternative Embodiments

The unified support UTILITY CARRYALL shown in FIGS. 6, 8 functions in the same manner as the steel tube fabricated UTILITY CARRYALL. The multiple adjustable coupling system introduces features that provide coupling options for using other support tools for front loaders on tractors. Another embodiment the support rack 22 provides support for is a 3point coupling attachment 46 (FIGS. 2) and 48 (*a*)(*b*) (FIG. 3) for the hydraulic 3point hitch located on the rear of utility farm tractors. The coupling point 46 for the hydraulic 3point hitch top link is affixed at the top center of the front support rack 22. Two coupling points 48 (*a*)(*b*) (FIGS. 2 3) affixed near the bottom of the support uprights 50 (*a*)(*c*) are for coupling to the rear 3point hitch lift arms of the utility tractor. These coupling points are approximately 20 cm or (8 in.) from the bottom of the UTILITY CARRYALL deck and approximately 75 cm or (28 in.) between the two bottom coupling points.

Operation

FIGS. 1, 3, 5

The operational description of the parts and elements of my UTILITY CARRYALL will introduce major improvements over prior art. My UTILITY CARRYALL introduces structural design with reliable dependability for providing lift and transport support needs for both small and large tractors. These unique features and qualities insure maximum utilization of the hi-tech hydraulic lift system available on utility and skid steer tractors today.

To couple the UTILITY CARRYALL FIG. 1 to a utility tractor with a three point hitch, position the rear of the tractor close to the front support rack 22 (FIG. 3) of the UTILITY CARRYALL. Lower the three point hitch lift arms down close to the same level of the UTILITY CARRYALL's coupling points 48 (*a*)(*b*). Then move the tractor toward the UTILITY CARRYALL until final coupling alignment can be accomplished by maneuvering the UTILITY CARRYALL manually. Ease the lift arms of the tractor onto the coupling pins (not shown) and secure by placing snap ring pins in the holes of the coupling pins. The 3point hydraulic hitch on the tractor has an adjusting top link attached. The free end has a bearing with a hole in it. The bearing end is positioned for alignment with the holes in the coupling device 46 located at the top center of the front support rack 22 of the UTILITY CARRYALL. The coupling pin (not shown) is eased into the aligned holes of the carryall coupling 46 and the hole in the bearing at the end of the adjusting top link and secured. At this point the UTILITY CARRYALL is operational and can be used for a lift and transport support.

When coupling the UTILITY CARRYALL to the front loader on a utility or a skid steer tractor with conventional coupling units 58 (*a*)(*b*) quick coupling units 60 (*a*)(*b*) or 66 (FIG. 5) position the tractor facing the front support rack 22. The tractor loader lift arms are positioned close to the coupling units of the carryall where final engagement can be accomplished by utilizing the hydraulic system on the tractor for final alignment. Coupling pins are inserted through the holes at the bottom of the conventional coupling units 58 (*a*)(*b*) and the lift arms of the loader are secured with snap ring pins. The hydraulic tilt control piston rods are positioned for alignment with the holes at the top of the conventional coupling units 58 (*a*)(*b*). Final alignment adjustments are accomplished by the use of the hydraulic system. When this is achieved insert a coupling pin through the top holes of the coupling unit and the hole at the end of the hydraulic tilt piston rod and secure with a snap ring pin. When using the quick coupling units 60 (*a*)(*b*) the tractor is positioned facing the UTILITY CARRYALL in the same manner described above. Move the tractor slowly into the coupling units and the connection is automatically made. The UTILITY CARRYALL can be lifted off the ground and utilized for lift and transport support.

FIG. 5

Additional Embodiments

The introduction of the quick coupling units 60 (*a*)(*b*) FIG. 5 to the adjusting coupling system on the UTILITY CARRYALL is an embodiment introducing major improvements. These units are receiving receptacles providing automatic coupling features when utilized with front loaders having quick coupling systems. This coupling system is being adapted to all utility farm tractors, skid steer tractors and industrial tractors. Quick coupling units 60 (*a*)(*b*) FIG. 5 are designed for attachment to the adjusting support rails 56 (1 top and 1 bottom). Introduction of the quick coupling units as receptacles for the quick coupling system used on tractors today is a major time and energy saving improvement over prior art. This feature provides efficiency for the user to fully utilize today's hydraulic lift and transport support potential on utility tractors with hydraulic rear 3point hitch and front loader capabilities. The UTILITY CARRYALL can be utilized on industrial tractors or skid steer tractors by placing heavy duty quick coupling units 66 (FIG. 5 at view 2) on the adjusting rails of the multiple coupling system.

FIG. 8

Additional Embodiments

FIG. 8 shows a view looking under the deck of a unified UTILITY CARRYALL fabricated for use on small and medium sized tractors. The multiple adjusting coupling system is removed when the UTILITY CARRYALL is used with forklifts and is not illustrated. Forklift tong guides 68 affixed to the outside unified support members 64 introduces an embodiment that provides containment and support for the tongs on industrial motorized forklifts. The unified UTILITY CARRYALL can also be attached to forklifts coupled to front loaders or rear 3point hitches on utility tractors and on front loaders of skid steer and industrial tractors. This embodiment introduces a flexibility wherein the UTILITY CARRYALL provides a wide range of industrial support. The same forklift support device is provided with the large steel tube structured UTILITY CARRYALL.

FIGS. 6 and 8

Alternative Embodiments

The UTILITY CARRYALL illustrated in FIGS. 6-8 shows the carryall fabricated for small and medium sized utility tractors. The vertical extensions of the unified support members 64 (FIGS. 6 and 8) are structurally unified by affixing an elongated piece of angled steel to the tops thereof and affixing a flat ridged deck 20 (FIG. 1) material to the tops of the horizontal extensions of the unified support members. Designed elemental unification with integral features provides a wide range for increased structural support. Interrelated relationship between integral elements produced greater surface area for absorbing load stress. Employing these methods in fabrication design reduced the weight of the UTILITY CARRYALL by 40 percent with a 30 percent increase in structural support.

Advantages

From the description above a number of advantages of my UTILITY CARRYALL become evident:

It provides a beneficial working combination for load distribution, when coupled to the rear hydraulic 3point hitch on utility tractors with a bucket or another UTILITY CARRYALL attached on the front loader.

It provides safe and dependable support when coupled on front loaders and forklifts for work at higher elevations.

It provides farmers, ranchers and other industries efficient and dependable transport support when coupled to on site tractors already in place and owned.

(a) It provides a safe and reliable working platform with dependable lift and transport support capabilities.

(b) It provides ladder receptacles on the deck, for stable and reliable support for working at higher elevations.

(c) It introduces basic design features that provide flexible adaptation for unforeseen problems on job sites.

(d) It introduces unique structural design that provides structural support options for producing a carryall for all sizes of utility tractors.

(e) It can be utilized on the rear 3point hitch and on the front loader of utility tractors at the same time. This introduces a support improvement for many producers involved in the agricultural industry.

(f) It can be quickly uncoupled or coupled to a tractor that is already owned and in place. In most cases the tractor will provide greater ranges of dependable transportation support with the carryall than a more expensive vehicle.

(g) It features two distinct structural designs comprising:

a unified structural support method for use with small and medium sized tractors, and a steel tubing design fabricated for use with very large tractors.

CONCLUSIONS, RAMIFICATIONS, AND SCOPE OF INVENTION

Accordingly, the reader will see that my UTILITY CARRYALL introduces major support improvements over prior art with its wide range of multiple flexibility. Economical and reliable structural support that users can count on is provided in all working situations the UTILITY CARRYALL is designed to provide support for. My Utility Carryall is uniquely designed and structurally fabricated to provide dependable support when used with the high-tech utility and industrial tractors today and can be utilized on older tractors as well. The improvements my UTILITY CARRYALL provides over prior art introduces a support device users recognized a need for from the time the hydraulic 3point hitch was conceived. The utility carryall has the additional advantage in that:

It provides a use for any number of wheels at the rear, underneath the UTILITY CARRYALL deck however, a single preferred wheel centered at the rear, under the deck provides the support needed in most situations.

It provides a hydraulic dumping capability for large utility tractors and a spring assisted manual dump for small utility tractors.

It provides a power lift ramp on the rear for large utility tractors if required.

It provides quick coupling units that function as receptacles for the quick coupling system employed with utility tractors of today.

Channel guides are provided on both sides of the front support rack and on both rear support post for wooden side racks and plywood panels. This feature offers simple and economically flexible load control devices that are reliable. Many types of material can be used to provide load control, and can be structurally designed in numerous ways.

It provides drop down expanded metal sides and tailgates that can be used for working surfaces if required.

It provides side racks with drawers and bins for storing tools and miscellaneous support items These racks can be designed in many different ways with numerous support options, such as many shapes and forms of devices for hanging support equipment and hand tools.

It provides tie down rods extending the length on each side of the deck.

It provides an overhead canopy for protective features during adverse weather. This feature can be introduced in many shapes and sizes.

It provides sideboards with a hinged device that allows a section of the sides to drop down and form a seat for people to use if required.

It provides a towing device centered and affixed on the rear frame support.

It provides a multiple adjustable coupling system that can be utilized for coupling other support tools to the hydraulic system on the rear and front of utility tractors.

Although the descriptions above contains many specificities these should not be construed as limiting the scope of my invention but as merely providing illustrations of some of the presently preferred embodiments of my invention. For example my UTILITY CARRYALL can have many other shapes it could be narrow, wide, light or heavy. The coupling devices and frame work could employ numerous different designs, etc. As an example, the unified structural support technique employed to fabricate a UTILITY CARRYALL for use with small and medium size tractors. The profile design of the unified support members, structurally provide interrelated elemental bonding. All elements of the UTILITY CARRYALL are affixed to or supported by the unified support members, providing major structural support improvements. Thus the scope of my invention should be determined by the appended claims and their legal equivalents, rather than by the examples given.

I claim:

1. A utility carryall for lift and transport support when coupled to a front loader or rear three point hitch on utility tractors comprising:

a front support rack providing an attachment means;

a deck providing a transport means, the deck comprising:

a rectangular shaped support frame having a number of front, rear and outside frame rails being affixed at all four corners further including a plurality of deck support rails being disposed and affixed to the front and rear frame rails within;

an inside deck support strip being disposed and affixed to the inside face of each of the outside frame rails thereof further including a flat rigid material being disposed and affixed to the deck support rails and the inside deck support strips;

the front support rack having a rectangular shape and being the same width as the deck with a number of outside frame rails being affixed together at corners thereof and having a plurality of support uprights being disposed and affixed within further including disposing and affixing together the bottoms thereof to front frame rail of the deck;

a number of side panel receptacles being disposed and affixed on the outside frame and rails thereof;

the attachment means being disposed and affixed to the front support rack wherein providing a means for coupling the utility carryall to a three point hitch on utility tractors; and a multiple adjustable coupling system providing an attachment means for coupling the utility carryall to all front loaders on utility tractors wherein the improvement comprising;

(a). a number of top and bottom aligned rail support hangers having a predetermined size and shape wherein being disposed and affixed on the front support rack further including a plurality of set bolts being disposed and affixed on tops of the support hangers providing a support means for a number of adjusting support rails;

(b). the adjusting support rails having a predetermined size and shape with one being inserted through each of the aligned top and bottom support hangers providing a sliding adjustment means for a number of coupling units being disposed thereon;

(c). the coupling units each having a predetermined size and shape with rail support hangers being disposed and affixed one on a top and bottom of the rear thereof further including set bolts being disposed and affixed on the tops thereof providing a means for fixing the coupling units and adjusting support rails in place after final adjustments, whereby the multiple adjusting coupling system introduces a new dimension for safe reliable lift and transport support with utility tractors wherein providing a means for dispersing load stress throughout the combined surface areas of the utility carryall and further including a means for coupling the utility carryall to the varying widths of all lift arms on front loaders.

* * * * *